US009696683B2

(12) United States Patent
Maeda et al.

(10) Patent No.: US 9,696,683 B2
(45) Date of Patent: Jul. 4, 2017

(54) ELECTRONIC DEVICE AND IMAGE FORMING APPARATUS

(71) Applicant: KYOCERA Document Solutions Inc., Osaka (JP)

(72) Inventors: Hiroyuki Maeda, Osaka (JP); Hidehisa Konishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 2 days.

(21) Appl. No.: 15/090,943

(22) Filed: Apr. 5, 2016

(65) Prior Publication Data

US 2016/0291534 A1 Oct. 6, 2016

(30) Foreign Application Priority Data

Apr. 6, 2015 (JP) ..... 2015-077797

(51) Int. Cl.
*G03G 21/00* (2006.01)
*G03G 21/16* (2006.01)

(52) U.S. Cl.
CPC ... *G03G 21/1633* (2013.01); *G03G 2221/169* (2013.01)

(58) Field of Classification Search
CPC ..... G03G 21/1633; G03G 21/1647; G03G 15/0832; G03G 15/757; G03G 2221/169; G03G 2221/1687
USPC ..... 399/110, 114, 125
See application file for complete search history.

(56) References Cited

U.S. PATENT DOCUMENTS

2010/0078884 A1* 4/2010 Uehara ..... G03G 21/1638 271/314
2013/0243476 A1* 9/2013 Sato ..... G03G 21/1623 399/110
2013/0287433 A1* 10/2013 Ito ..... G03G 21/1619 399/107

FOREIGN PATENT DOCUMENTS

JP 2006-231739 A 9/2006

* cited by examiner

*Primary Examiner* — Walter L Lindsay, Jr.
*Assistant Examiner* — Jessica L Eley
(74) *Attorney, Agent, or Firm* — Studebaker & Brackett PC

(57) ABSTRACT

An image forming apparatus includes a front cover and a maintenance cover. The front cover has a support section, an interference section, and a projection. The support section is supported by a housing of the image forming apparatus so as to be pivotable about a pivot axis. The interference section extends rearward from an edge of the front cover. The projection is located on a contact surface that comes in or out of contact with a specific section of the maintenance cover as the front cover is closed or opened with the maintenance cover in a closed state. The specific section of the maintenance cover has a hole. The projection fits in the hole.

14 Claims, 11 Drawing Sheets

ELECTRONIC DEVICE AND IMAGE FORMING APPARATUS

INCORPORATION BY REFERENCE

The present application claims priority under 35 U.S.C. §119 to Japanese Patent Application No. 2015-077797, filed on Apr. 6, 2015. The contents of this application are incorporated herein by reference in their entirety.

BACKGROUND

The present disclosure relates to an electronic device such as an image forming apparatus that forms images on a recording medium (for example, paper).

The image forming apparatus includes a front cover and a maintenance cover. The front cover is openable and closable not only by a maintainer but also by a user. The maintenance cover is openable and closable only by a maintainer. The maintenance cover therefore has a lock mechanism that can be unlocked only by a maintainer.

SUMMARY

An electronic device according to the present disclosure includes a main body, a first cover, and a second cover. The first cover is supported pivotally relative to the main body. The second cover is located adjacent to the first cover and supported pivotally relative to the main body. The first cover has a first front face, a support section, and an interference section. The first front face has an edge adjacent to the second cover. The support section is located on a rear surface of the first front face at a side closest to the edge and supported by the main body so as to be pivotable about a pivot axis along the edge. The interference section extends rearward from the edge and interferes with a trajectory of an opening movement of the second cover when the first cover is open by a pivot angle no less than a specific pivot angle. The second cover has a second front face, a specific section, and one of a protrusion and a recess. The specific section is located on a rear surface of the second front face at a side closest to the first cover and faced toward the first cover. The one of the protrusion and the recess is located on or in the specific section. The support section of the first cover has a contact surface and the other of the protrusion and the recess. The contact surface comes in or out of contact with the specific section of the second cover as the first cover is closed or opened with the second cover in a closed state. The other of the protrusion and the recess is located on or in the contact surface. The protrusion fits in the recess when the first cover is closed with the second cover in the closed state, and the protrusion comes out of the recess when the first cover is opened with the second cover in the closed state.

DETAILED DESCRIPTION

Figure 1:
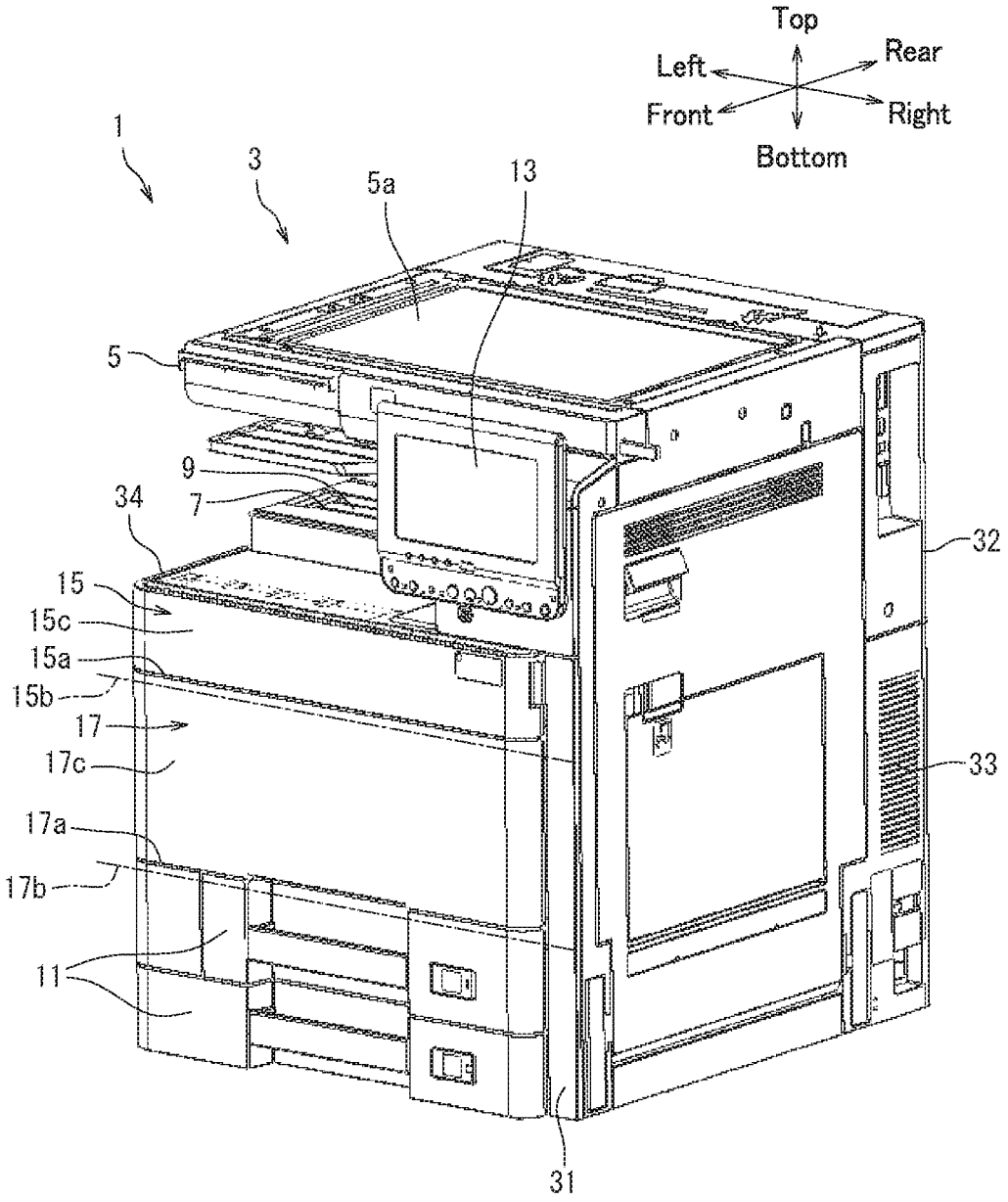
FIG. 1 is a perspective view illustrating external appearance of an image forming apparatus according to an embodiment of the present disclosure.

The following describes an embodiment of the present disclosure with reference to the accompanying drawings. Note that elements that are the same or equivalent are indicated by the same reference signs in the drawings and description thereof is not repeated.

Description of Configuration

The following describes an image forming apparatus according to the present embodiment with reference to FIG. 1. FIG. 1 is a perspective view illustrating external appearance of the image forming apparatus according to the embodiment of the present disclosure.

An image forming apparatus 1 according to the present embodiment is an apparatus for forming images on paper. As illustrated in FIG. 1, the image forming apparatus 1 includes a housing (main body) 3, a document reading section 5, an exit tray 9, a paper feed cassette 11, an image forming section (not illustrated), a paper conveyance section (not illustrated), an operation section 13, a front cover 15 (first cover), and a maintenance cover 17 (second cover).

The housing 3 is in the shape of a substantially rectangular parallelepiped box having a front surface 31, a rear surface 32, a right surface 33, and a left surface 34. A side of the image forming apparatus 1 with the front surface 31 is defined as a front side. A side of the image forming apparatus 1 with the rear surface 32 is defined as a rear side. A side of the image forming apparatus 1 with the right surface 33 is defined as a right side. A side of the image forming apparatus 1 with the left surface 34 is defined as a left side. The housing 3 has a space 7. The space 7 is located at an upper part of the housing 3 and opened at the left surface and at the front surface.

The document reading section 5 is located at the upper part of the housing 3. The document reading section 5 has a document loading surface 5*a*. After paper is loaded on the document loading surface 5*a*, the document reading section 5 reads, as image information, information printed on a surface of the paper that is facing downward. The exit tray 9 is provided in the space 7. The paper feed cassette 11 is disposed at a lower part of the housing 3. A stack of sheets of paper is loaded in the paper feed cassette 11.

The image forming section is located inside of a middle part of the housing 3 in a top-bottom direction. The image forming section forms an image on paper based on image information read by the document reading section 5. The paper conveyance section is located inside of the housing 3.

The paper conveyance section picks up the sheets of paper in the paper feed cassette 11 one sheet at a time and conveys the paper to the image forming section. The paper conveyance section then conveys the paper from the image forming section to the exit tray 9.

The operation section 13 is disposed at a specific position (for example, an upper right position) in the front surface 31 of the housing 3. The operation section 13 receives various settings of the image forming apparatus 1 and an operation instruction from a user. The various settings of the image forming apparatus 1 are for example settings of the number of copies to be printed, duplex printing, black/white inversion, magnification, and density. The operation instruction is an operation of a start button to instruct initiation of an image formation process. A user inputs the various settings and the operation instruction through operation of the operation section 13 to cause the image forming apparatus 1 to perform an image formation process.

The front cover 15 is disposed on the front surface 31 of the housing 3 at a position under the space 7. The maintenance cover 17 is disposed on the front surface 31 of the housing 3 at a position between the front cover 15 and the paper feed cassette 11.

The front cover 15 is supported by the housing 3 so as to be pivotable about a pivot axis 15*b*. The pivot axis 15*b* is located at a lower edge 15*a* (edge) of a front face 15*c* (first front face) of the front cover 15 and extends along the lower edge 15*a*. When the front cover 15 is pivoted frontward to be open, a part of the inside of the housing 3 that is located under the space 7 is exposed. The maintenance cover 17 is supported by the housing 3 so as to be pivotable about a pivot axis 17*b*. The pivot axis 17*b* is located at a lower edge 17*a* of a front face 17*c* (second front face) of the maintenance cover 17 and extends along the lower edge 17*a*. When the maintenance cover 17 is pivoted frontward to be open, a part of the inside of the housing 3 that is located between the front cover 15 and the paper feed cassette 11 is exposed.

In the present embodiment, the lower edge 15*a* of the front cover 15 is adjacent to the maintenance cover 17. The front cover 15 and the maintenance cover 17 are both top open covers. More specifically, the pivot axis 17*b* of the maintenance cover 17 is parallel to the pivot axis 15*b* of the front cover 15 and is located at a side of the maintenance cover 17 that is farthest from the front cover 15.

The image forming section according to the present embodiment for example forms an image on paper through transferring and fixing of a toner image to the paper. To this end, the image forming section includes a photosensitive drum, a charger, a light exposure device, a developing device, a toner container, a primary transfer device, an intermediate transfer belt, a secondary transfer device, and a fixing device.

The charger charges a surface of the photosensitive drum. The light exposure device irradiates the charged surface of the photosensitive drum with light to form an electrostatic latent image according to image information. The toner container supplies toner to the developing device. The developing device develops the electrostatic latent image on the surface of the photosensitive drum into a toner image. The primary transfer device transfers the toner image from the surface of the photosensitive drum to a surface of the intermediate transfer belt. The intermediate transfer belt conveys the transferred toner image to the fixing device. The secondary transfer device transfers the toner image from the surface of the intermediate transfer belt to the paper. The fixing device fixes the transferred toner image to the paper. Through the fixing, an image is formed on the paper.

Of the elements of the image forming section, the toner container is for example disposed behind the front cover 15 within the housing 3. Furthermore, the other elements of the image forming section than the toner container (i.e., the photosensitive drum, the charger, the light exposure device, the developing device, the intermediate transfer belt, the primary transfer device, the secondary transfer device, and the fixing device) are for example disposed behind the maintenance cover 17 within the housing 3.

The front cover 15 according to the present embodiment is for example used for replacement of toner containers and is therefore openable and closable not only by a maintainer but also by a user. The maintenance cover 17 is for example used for replacement of parts of the other elements of the image forming section than the toner container and is therefore openable and closable only by a maintainer. The image forming apparatus 1 therefore has a lock mechanism. The lock mechanism restricts opening of the maintenance cover 17 by a user. The lock mechanism will be described later in detail with reference to FIGS. 3 and 4.

Figure 2:
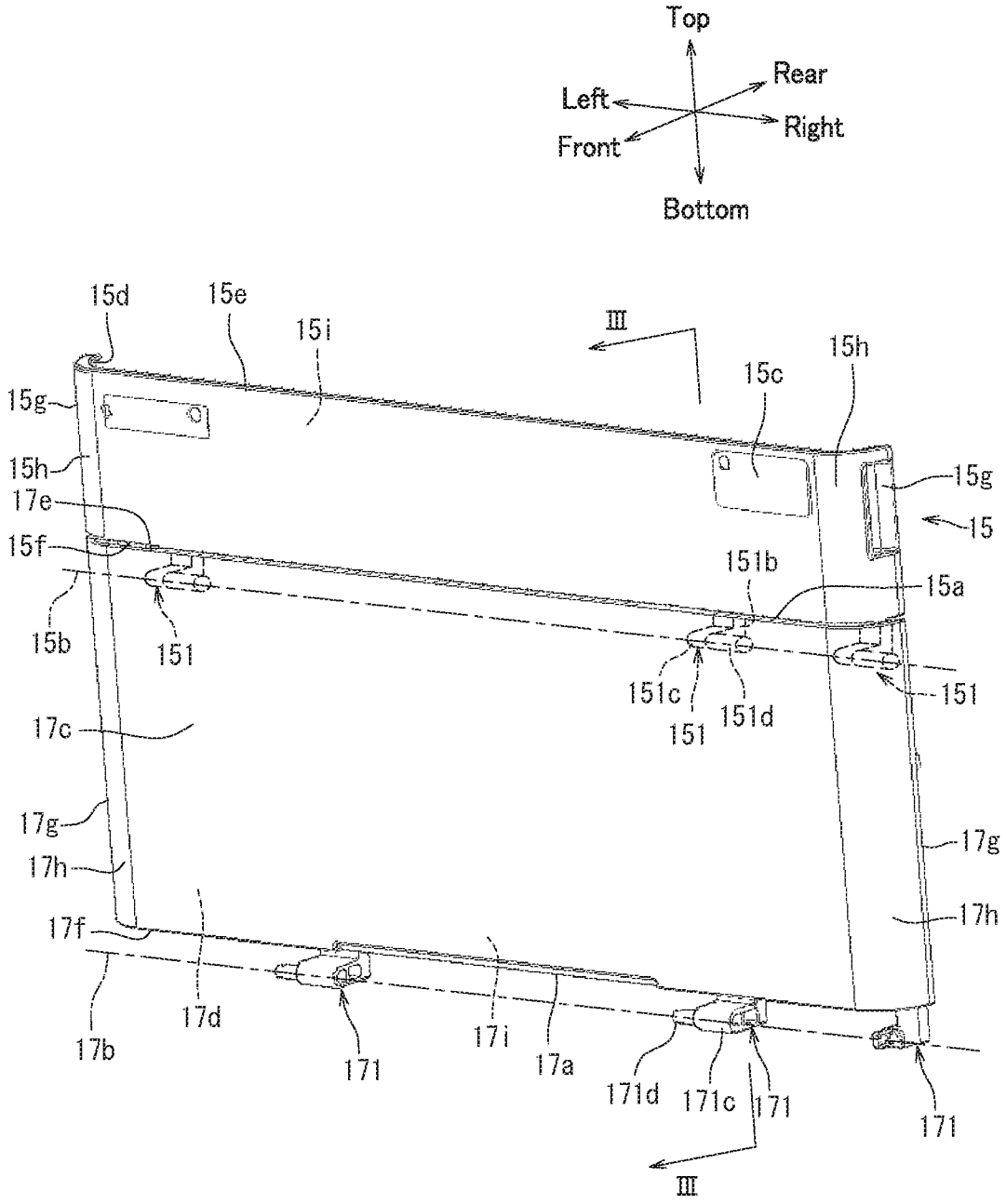
FIG. 2 is a perspective view, from a front side of the image forming apparatus, of a maintenance cover and a front cover disposed on a housing.
Figure 3:
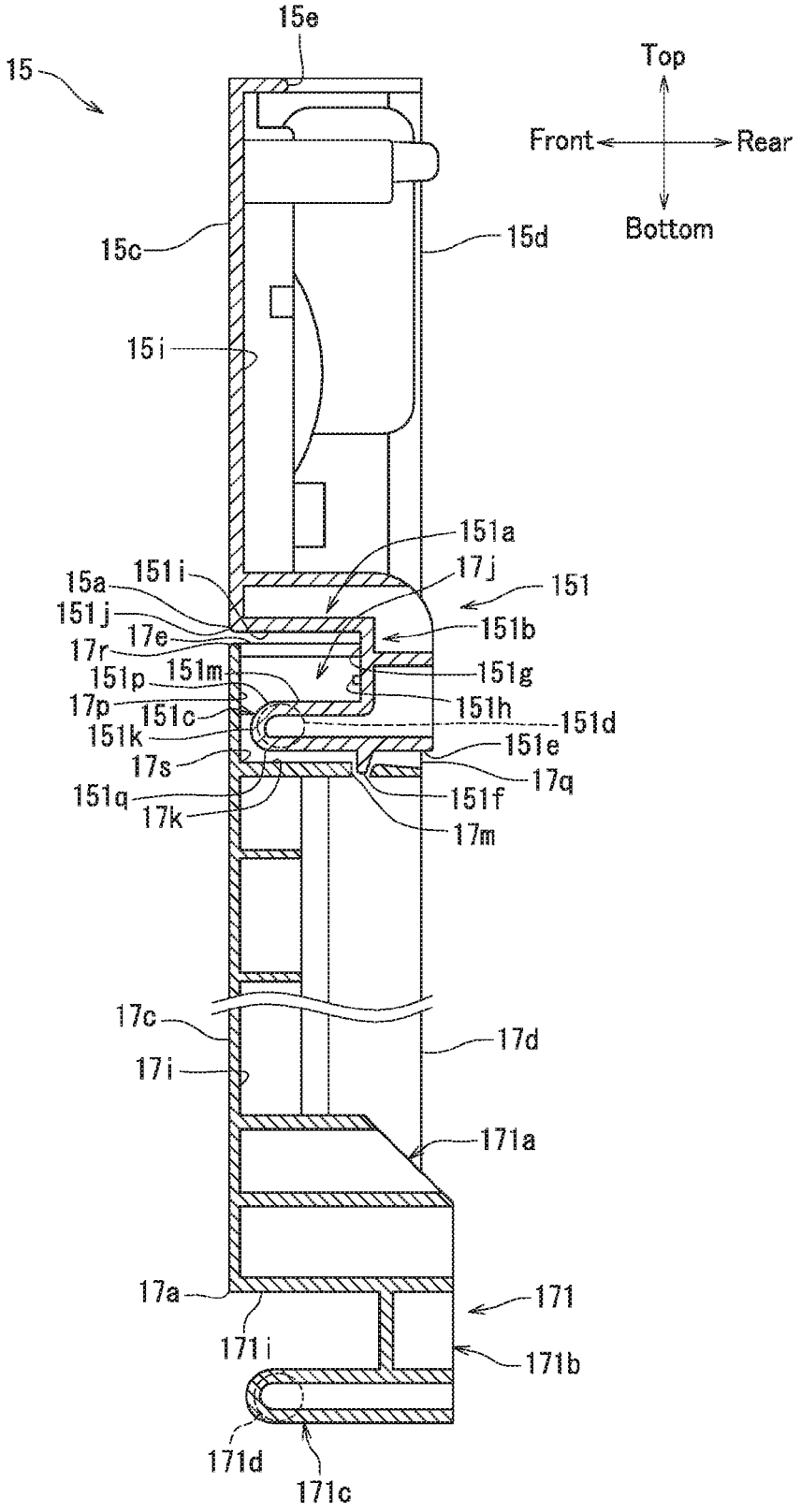
FIG. 3 is a cross-sectional view taken along line III-III in FIG. 2.
Figure 4:
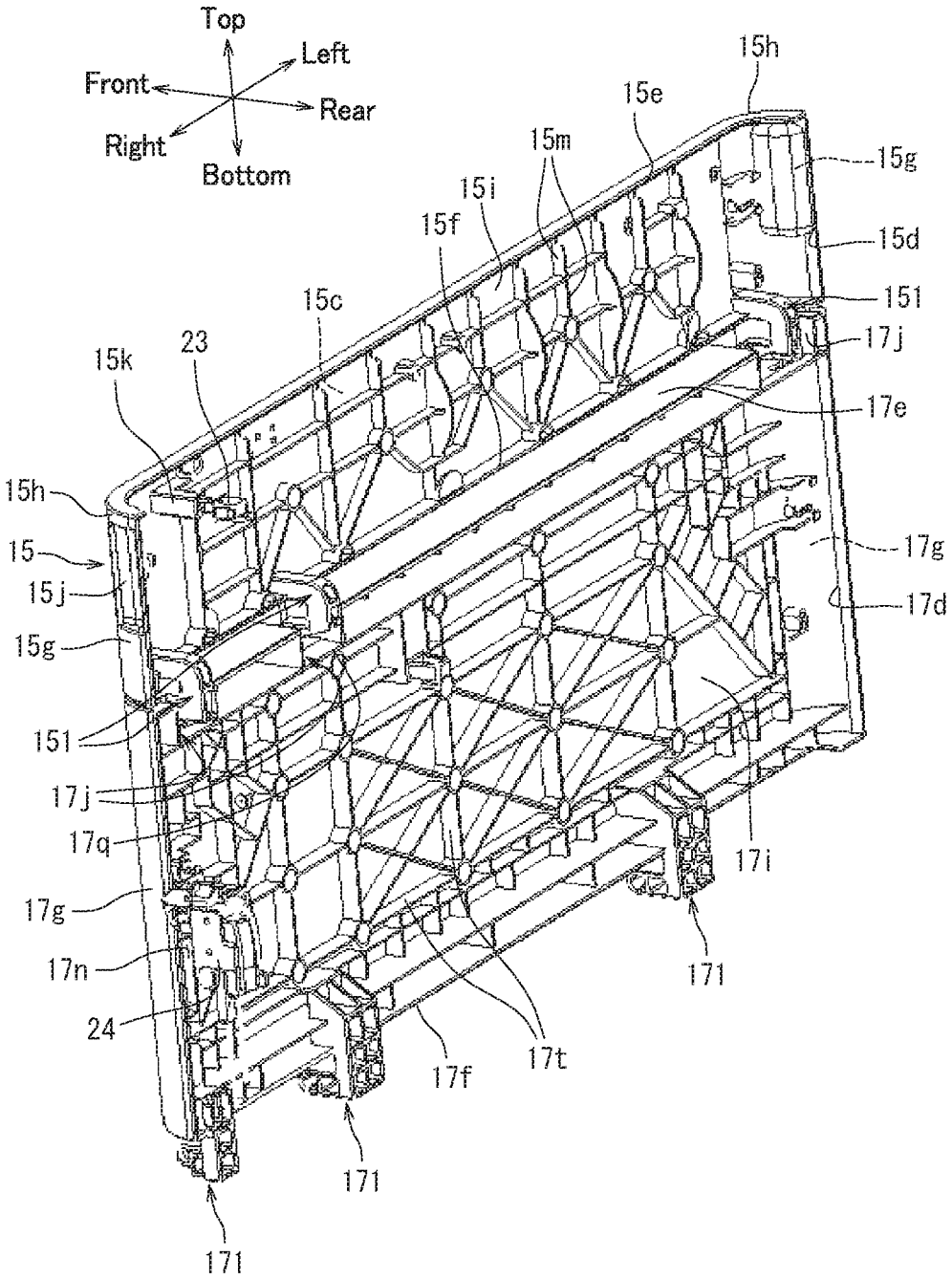
FIG. 4 is a perspective view, from a rear side of the image forming apparatus, of the maintenance cover and the front cover disposed on the housing.

The following describes the front cover 15 and the maintenance cover 17 in detail with reference to FIGS. 2 to 4. FIG. 2 is a perspective view, from the front side of the image forming apparatus 1, of the front cover 15 and the maintenance cover 17 disposed on the housing 3. FIG. 3 is a cross-sectional view taken along line III-III in FIG. 2. FIG. 4 is a perspective view, from the rear side of the image forming apparatus 1, of the front cover 15 and the maintenance cover 17 disposed on the housing 3.

As illustrated in FIG. 2, the front cover 15 for example has a horizontally long thin rectangular box shape having the front face 15*c*, an open rear face 15*d*, an open top face 15*e*, an open bottom face 15*f*, and right and left side faces 15*g*. The front cover 15 has convex corners 15*h* at boundaries between the front face 15*c* and the right and left side faces 15*g*. The convex corners 15*h* are beveled in an arc shape.

The front cover 15 has a support section 151. The front cover 15 is supported on the support section 151 so as to be pivotable about the pivot axis 15*b* relative to the housing 3. The support section 151 is provided on a rear surface 15*i* of the front face 15*c* of the front cover 15 at a side closest to the lower edge 15*a* of the front face 15*c*. The support section 151 extends below the lower edge 15*a*. The front cover 15 for example has three support sections 151. The support sections 151 are arranged in a left-right direction at intervals at the lower edge 15*a* of the front face 15*c*. More specifically, one support section 151 is disposed at each of right and left ends of the lower edge 15*a* of the front face 15*c*, and one support section 151 is disposed at a position shifted to the right of a midpoint in the left-right direction. Handles 15*j* are provided in the right and left side faces 15*g* at positions close to the open top face 15*e*. The handles 15*j* are held by hands for opening and closing the front cover 15. The handles 15*j* are recesses formed in the side faces 15*g*. The front cover 15 can be readily opened by holding the handles 15*j* by hands and pulling the front cover 15 frontward.

The maintenance cover 17 for example has a thin rectangular box shape having the front face 17*c*, an open rear face 17*d*, a top face 17*e*, a bottom face 17*f*, and right and left side faces 17*g*. The maintenance cover 17 has convex corners 17*h* at boundaries between the front face 17*c* and the right and left faces 17*g*. The convex corners 17*h* are beveled in an arc shape.

The maintenance cover 17 has a support section 171. The maintenance cover 17 is supported on the support section 171 so as to be pivotable about the pivot axis 17*b* relative to the housing 3. The support section 171 is provided on a rear surface 17*i* of the front face 17*c* of the maintenance cover 17. The support section 171 extends below the bottom face 17*f*. The maintenance cover 17 for example has three support sections 171. The support sections 171 are arranged in the left-right direction at intervals at the bottom face 17*f* of the maintenance cover 17. More specifically, one support section 171 is disposed at each side of a central portion of the bottom face 17*f* in the left-right direction, and one support section 171 is disposed at an end (for example, right end) of the bottom face 17*f* in the left-right direction.

As illustrated in FIG. 3, each of the support sections 151 of the front cover 15 has an attachment base 151*a* (first base), a coupling base 151*b* (second base), a supporting base 151*c* (third base), and a pivot shaft 151*d*. The attachment base 151*a* is provided on the rear surface 15*i* of the front face 15*c* of the front cover 15 and extends toward the open rear face 15*d* (i.e., extends rearward from the front cover 15). A front edge 151*j* of a lower surface 151*i* (interference section) of the attachment base 151*a* coincides with the lower edge 15*a* of the front face 15*c* of the front cover 15. The attachment base 151*a* therefore extends from the lower edge 15*a* toward the open rear face 15*d*. The lower surface 151*i* is perpendicular to the rear surface 15*i*.

The coupling base 151*b* extends below the lower edge 15*a* (closer to the second cover than the edge) from a distal end of the attachment base 151*a*. The supporting base 151*c* extends from a distal end of the coupling base 151*b* toward the front face 15*c* of the front cover 15. The supporting base 151*c* has a convex corner 151*p* (first convex corner) and a convex corner 151*q* (second convex corner). The convex corner 151*p* is formed by a boundary between a distal end 151*k* and an upper surface 151*m* of the supporting base 151*c*. The convex corner 151*q* is formed by a boundary between the distal end 151*k* and a lower surface 151*e* of the supporting base 151*c*. The convex corner 151*p* and the convex corner 151*q* are beveled in an arc shape. The pivot shaft 151*d* is provided at the distal end 151*k* of the supporting base 151*c* and protrudes in a direction (for example rightward) along the left-right direction (see FIG. 2).

The lower surface 151*e* of the supporting base 151*c* (contact surface, surface on a side of the third base that faces toward the specific section) has a projection 151*f* (protrusion). A front surface 151*g* of the coupling base 151*b* (surface on a side of the second base that faces toward the first front face) has a projection 151*h*. The projection 151*h* is provided on the front surface 151*g* at a position spaced both from the attachment base 151*a* and from the supporting base 151*c*.

Each of the support sections 171 of the maintenance cover 17 has an attachment base 171*a*, a coupling base 171*b*, a supporting base 171*c*, and a pivot shaft 171*d*. The attachment base 171*a* is provided on the rear surface 17*i* of the front face 17*c* of the maintenance cover 17 and extends toward the open rear face 17*d* (i.e., extends rearward from the maintenance cover 17). A lower surface 171*i* of the attachment base 171*a* is in the same plane as the bottom face 17*f* of the maintenance cover 17. The coupling base 171*b* extends below the bottom face 17*f* from a distal end of the attachment base 171*a*. The supporting base 171*c* extends from a distal end of the coupling base 171*b* toward the front face 17*c* of the maintenance cover 17. The pivot shaft 171*d* is provided at a distal end of the supporting base 171*c* and protrudes in a direction (for example leftward) along the left-right direction (see FIG. 2).

The top face 17*e* of the maintenance cover 17 has accommodation recesses 17*j*. The accommodation recesses 17*j* accommodate the support sections 151 of the front cover 15. Thus, the support sections 151 are disposed behind the maintenance cover 17. The top face 17*e* of the maintenance cover 17 for example has three accommodation recesses 17*j*. The accommodation recesses 17*j* are arranged in the top face 17*e* at intervals in one-to-one correspondence with the support section 151 of the front cover 15 (see FIG. 4). Each of the accommodation recesses 17*j* is elongated in a front-rear direction. A front face 17*p* of each accommodation recess 17*j* is closed by the rear surface 17*i* of the front face 17*c* of the maintenance cover 17, and a rear face 17*q* of each accommodation recess 17*j* is opened by the open rear face 17*d* of the maintenance cover 17. A bottom 17*k* (specific section) of each accommodation recess 17*j* has a hole 17*m* (recess). The projection 151*f* of each support section 151 of the front cover 15 fits in the corresponding hole 17*m*. The bottom 17*k* is located rearward of the maintenance cover 17 at a side closest to the front cover 15 and faced toward the front cover 15.

In each accommodation recess 17*j*, the corresponding pivot shaft 151*d* of the front cover 15 is located near a concave corner 17*s* of the accommodation recess 17*j*. Thus, the distal end 151*k* of the supporting base 151*c* is located near the concave corner 17*s*. The concave corner 17*s* is formed by a boundary between the front face 17*p* and the bottom 17*k* of the accommodation recess 17*j*. When both the front cover 15 and the maintenance cover 17 are in a closed state, the front face 17*c* of the maintenance cover 17 is in the same plane as the front face 15*c* of the front cover 15. An upper edge 17*r* of the front face 17*c* of the maintenance cover 17 is adjacent to the lower edge 15*a* of the front face 15*c* of the front cover 15.

In the present embodiment, the projections 151*f* of the support sections 151 of the front cover 15 and the holes 17*m* of the accommodation recesses 17*j* of the maintenance cover 17 form a first lock mechanism. The first lock mechanism locks the maintenance cover 17 in the closed state through the projections 151*f* fitting in the holes 17*m*. The lower surfaces 151*i* of the attachment bases 151*a* of the support sections 151 of the front cover 15 form a second lock mechanism. The second lock mechanism locks the maintenance cover 17 in the closed state through the lower surfaces 151*i* interfering with a trajectory of an opening movement of the maintenance cover 17. Thus, the lower surfaces 151*i* function as the interference sections. The projections 151*h* of the support sections 151 of the front cover 15 form a third lock mechanism. The third lock mechanism locks the maintenance cover 17 in the closed state through the projections 151*h* engaging with the front face 17*c* of the maintenance cover 17. The first lock mechanism, the second lock mechanism, and the third lock mechanism form the lock mechanism of the present embodiment. The lock mechanism of the present embodiment locks the maintenance cover 17 in the closed state through one of the first lock mechanism, the second lock mechanism, and the third lock mechanism locking the maintenance cover 17. Operation of the lock mechanism of the present embodiment will be described in the section of "Explanation of Operation".

Since the lock mechanism is formed by the holes 17*m*, the projections 151*f*, the projections 151*h*, and the lower surfaces 151*i* as described above, the lock mechanism needs fewer elements and a smaller placement space. Furthermore, since the projections 151*f*, the projections 151*h*, and the lower surfaces 151*i* forming the lock mechanism are portions of the front cover 15, and the holes 17*m* forming the lock mechanism are portions of the maintenance cover 17, users cannot easily recognize the lock mechanism. As a result, users are prevented from touching the lock mechanism on purpose or by mistake. Furthermore, since the projections 151*f*, the projections 151*h*, and the lower surfaces 151*i* forming the lock mechanism are portions of the support sections 151, users cannot easily recognize the lock mechanism. Furthermore, since the support sections 151 of the front cover 15 are disposed behind the maintenance cover 17, the support sections 151 are less visible from outside. As a result, the lock mechanism does not easily attract users' notice.

As illustrated in FIG. 4, the housing 3 includes a cover opening detection switch 23 and an interlock switch 24. Note that the housing 3 is not shown in FIG. 4 in order to facilitate preparation of the drawings.

The front cover 15 has a projection 15*k* for cover opening detection. The projection 15*k* pushes the cover opening detection switch 23 when the front cover 15 is in the closed state. The projection 15*k* is for example located on the rear surface 15*i* of the front cover 15 at a position above the rightmost support section 151. That is, the projection 15*k* is provided on the rear surface 15*i* at a stable position near the support section 151. Thus, the projection 15*k* is accurately positioned relative to the cover opening detection switch 23 so as to push the cover opening detection switch 23. The projection 15*k* protrudes rearward beyond the open rear face 15*d* of the front cover 15. The rear surface 15*i* of the front cover 15 has lateral and longitudinal reinforcing ribs 15*m*. Furthermore, the rear surface 15*i* of the front cover 15 has magnetic members, not illustrated, attached thereto at positions near an upper end thereof and near the right and left ends thereof. When the front cover 15 is in the closed state, the magnetic members are kept in contact with sheet metal members of the housing 3 by magnetic attraction.

The maintenance cover 17 has a projection 17*n* for interlock. The projection 17*n* pushes the interlock switch 24 in the housing 3 when the maintenance cover 17 is in the closed state. The projection 17*n* is for example provided on the rear surface 17*i* of the maintenance cover 17 at a position above the rightmost support section 171. That is, the projection 17*n* is provided on the rear surface 17*i* at a stable position near the support section 171. Thus, the projection 17*n* is accurately positioned relative to the interlock switch 24 so as to push the interlock switch 24. The projection 17*n* protrudes rearward beyond the open rear face 17*d* of the maintenance cover 17. The rear surface 17*i* of the maintenance cover 17 has lateral and longitudinal reinforcing ribs 17*t*.

Figure 5:
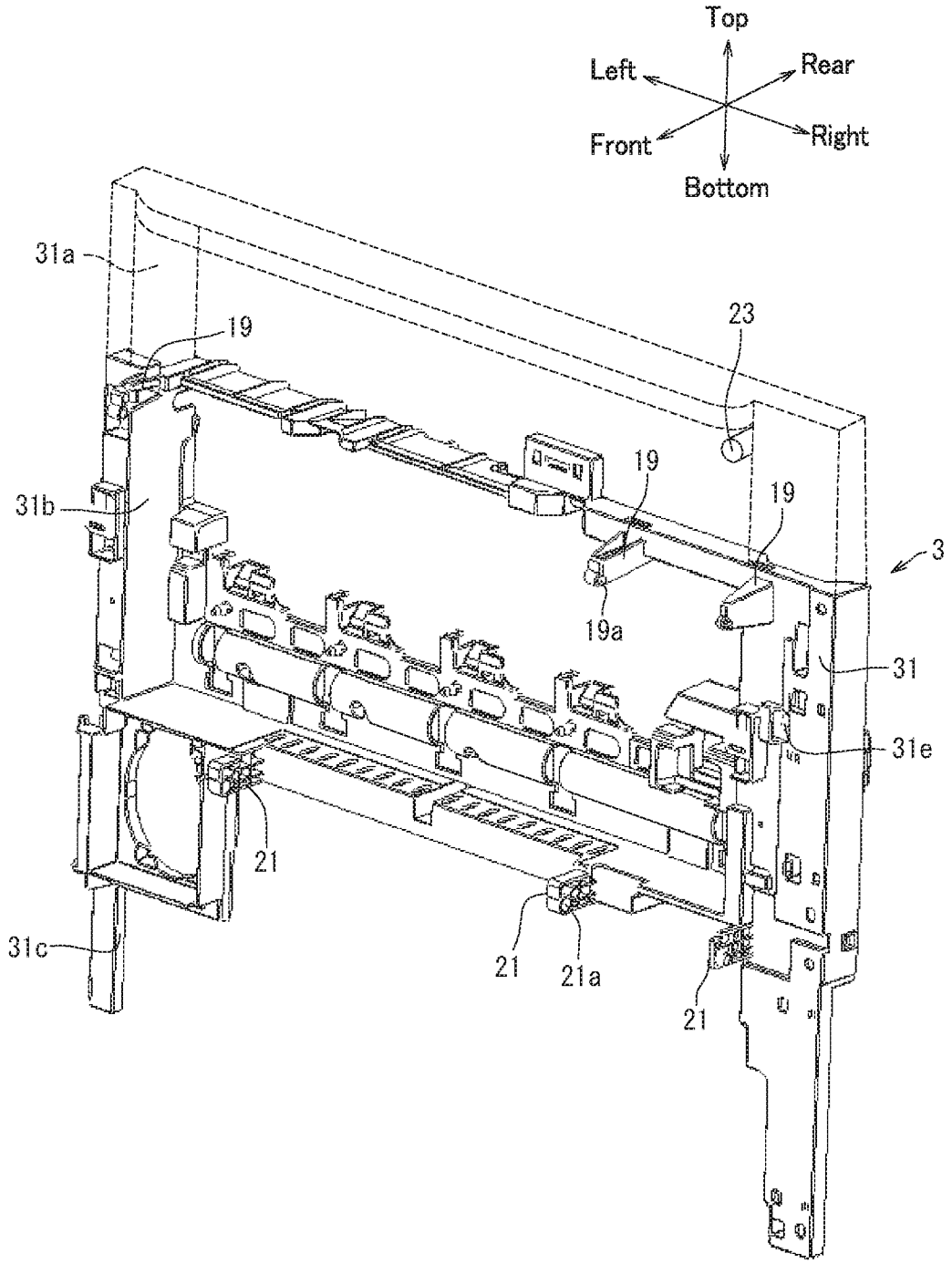
FIG. 5 is a perspective view of a front surface of the housing.
Figure 6:
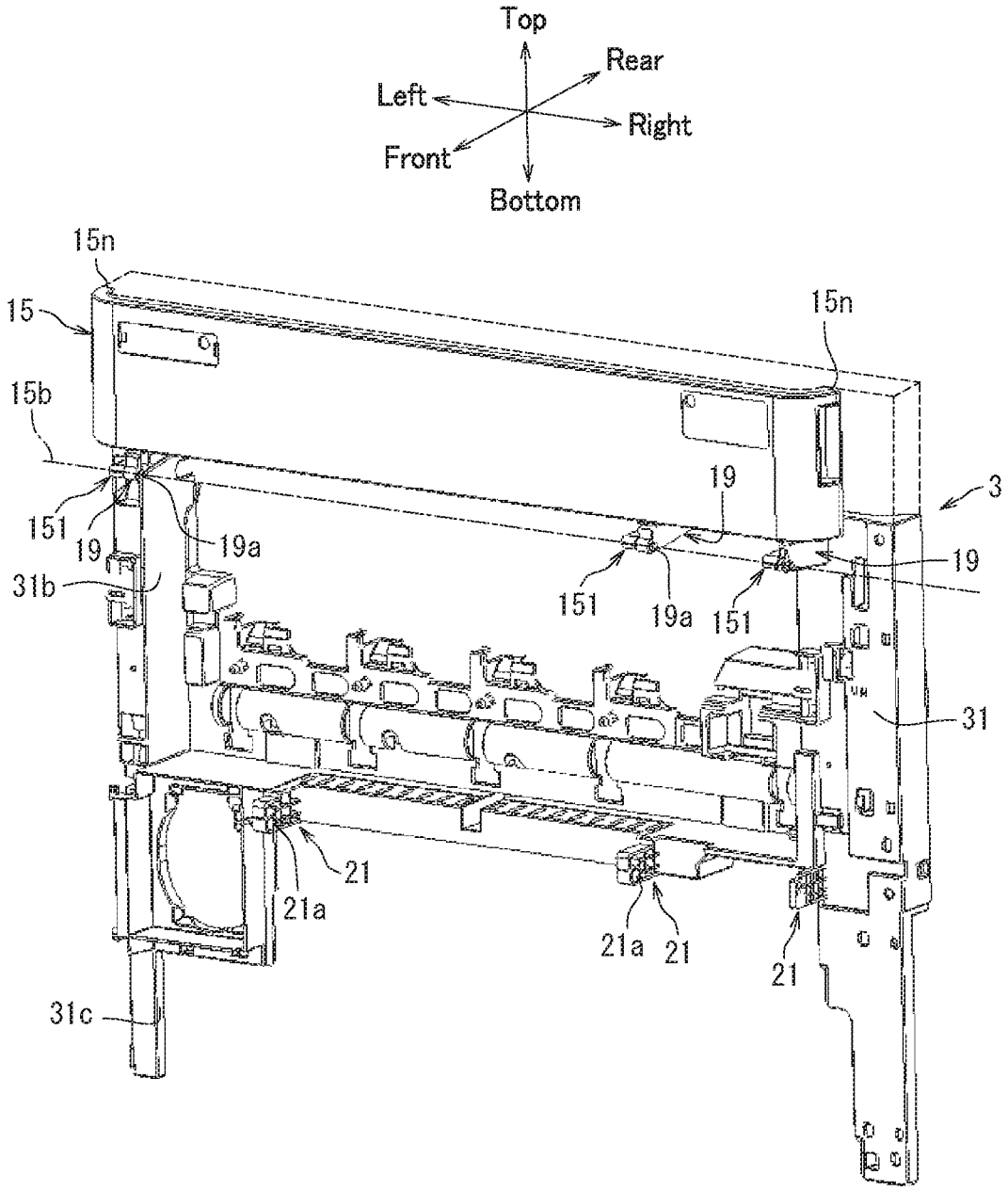
FIG. 6 is a perspective view of the front surface of the housing with the front cover attached thereto.
Figure 7:
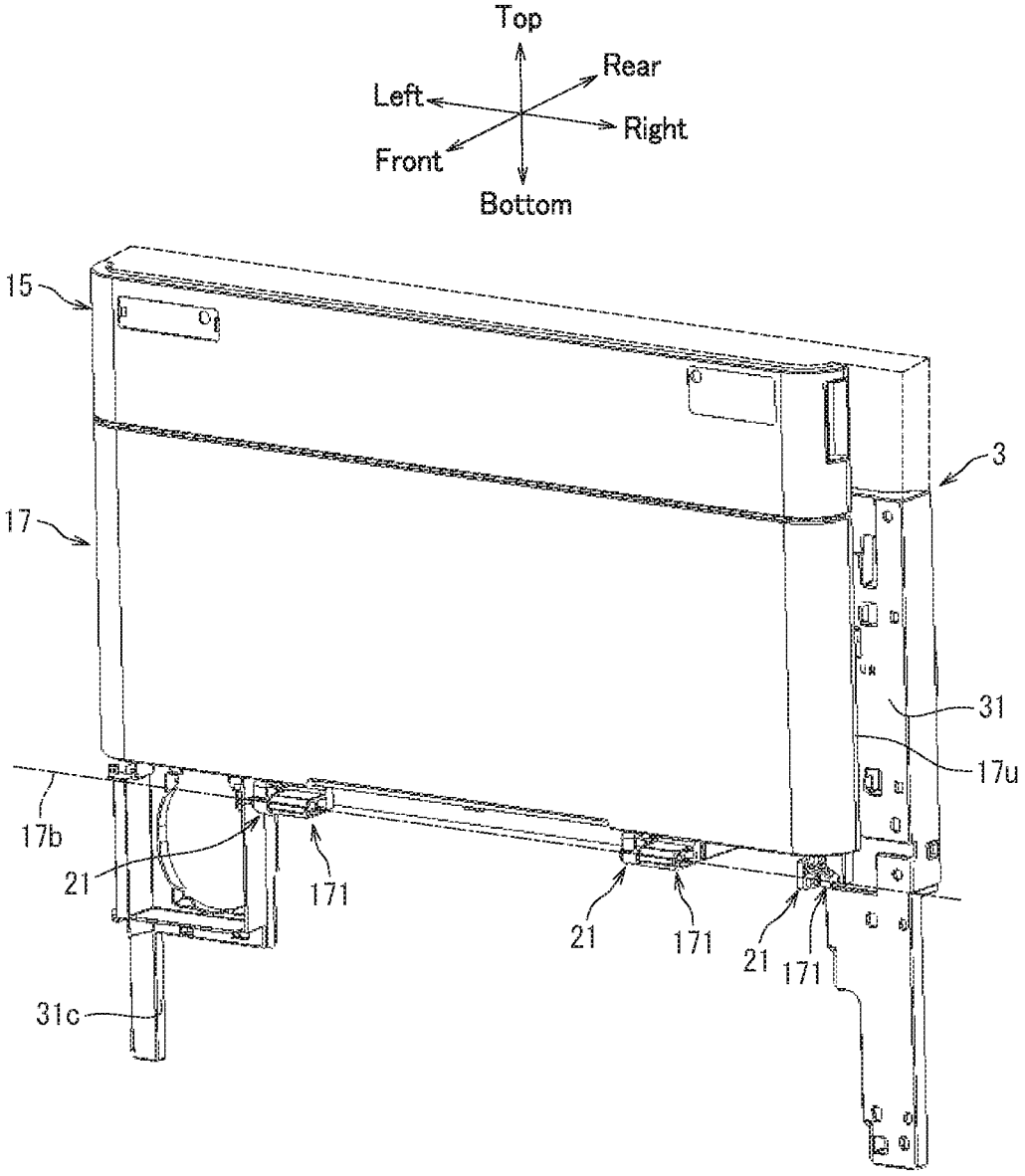
FIG. 7 is a perspective view of the front surface of the housing with the front cover and the maintenance cover attached thereto.

The following describes a cover supporting structure of the housing 3 with reference to FIGS. 5 to 7. FIG. 5 is a perspective view of the front surface 31 of the housing 3. FIG. 6 is a perspective view of the front surface 31 of the housing 3 with the front cover 15 attached thereto. FIG. 7 is a perspective view of the front surface 31 of the housing 3 with the front cover 15 and the maintenance cover 17 attached thereto. Note that in FIGS. 5 to 7, only the front surface 31 side of the housing 3 is shown and an upper part of the front surface 31 is depicted by dashed lines in order to facilitate preparation of the drawings.

As illustrated in FIG. 5, the front surface 31 of the housing 3 has an opening 31*a*, an opening 31*b*, and an opening 31*c*. The opening 31*a* has a horizontally long rectangular shape and is opened and closed by opening and closing the front cover 15. The opening 31*b* has a horizontally long rectangular shape and is opened and closed by opening and closing the maintenance cover 17. The opening 31*c* has a horizontally long rectangular shape through which the paper feed cassette 11 is taken in and out. The opening 31*a*, the opening 31*b*, and the opening 31*c* are arranged from top to bottom in stated order.

The housing 3 further has support sections 19 and support sections 21. The support sections 19 pivotally support the support sections 151 of the front cover 15. The housing 3 for example has three support sections 19. The support sections 19 are arranged at an upper end of the opening 31*b* at intervals in one-to-one correspondence with the support sections 151 of the front cover 15. The support sections 19 project frontward from the front surface 31. Each support section 19 has a shaft hole 19*a*. The shaft hole 19*a* is provided at a front end of the support section 19 and elongated in the left-right direction. The pivot shaft 151*d* of each support section 151 of the front cover 15 is inserted into the corresponding shaft hole 19*a*.

The support sections 21 pivotally support the support sections 171 of the maintenance cover 17. The housing 3 for example has three support sections 21. The support sections 21 are arranged at a lower end of the opening 31*b* at intervals in one-to-one correspondence with the support sections 171 of the maintenance cover 17. The support sections 21 project frontward from the front surface 31. Each support section 21 has a shaft hole 21*a*. The shaft hole 21*a* is provided at a front end of the support section 21 and elongated in the left-right direction. The pivot shaft 171*d* of each support section 171 of the maintenance cover 17 is inserted into the corresponding shaft hole 21*a*.

The front surface 31 of the housing 3 has a hole 31*e*. The projection 17*n* of the maintenance cover 17 is inserted into the hole 31*e*. A button section 24*a* of the interlock switch 24 is disposed inside of the hole 31*e*. The cover opening detection switch 23 is disposed at a specific position in the opening 31*a* (for example, at an upper right position in the opening 31*a*). The cover opening detection switch 23 and the interlock switch 24 will be described later with reference to FIG. 8.

As illustrated in FIG. 6, the pivot shaft 151*d* of each support section 151 of the front cover 15 is inserted into the shaft hole 19*a* of the corresponding support section 19 of the housing 3. As a result, the front cover 15 is supported so as to be pivotable about the pivot axis 15*b* relative to the housing 3. In FIG. 6, the front cover 15 is kept closed through the magnetic members being kept in contact with the sheet metal members on the front surface 31 of the housing 3 by specific force. The front cover 15 in the closed state closes the opening 31*a* of the housing 3 with right and left ends 15*n* of the open rear face 15*d* of the front cover 15 in contact with right and left ends of a periphery of the opening 31*a*. The front cover 15 in the closed state is opened frontward by pulling frontward the handles 15*j* in the right and left side faces 15*g* to release the magnet members from the sheet metal members on the front surface 31 of the housing 3.

As illustrated in FIG. 7, the pivot shaft 171*d* of each support section 171 of the maintenance cover 17 is inserted into the shaft hole 21*a* of the corresponding support section 21 of the housing 3. As a result, the maintenance cover 17 is supported so as to be pivotable about the pivot axis 17*b* relative to the housing 3. The maintenance cover 17 is closed in FIG. 7. The maintenance cover 17 in the closed state closes the opening 31*b* of the housing 3 with a periphery 17*u* of the open rear face 17*d* of the maintenance cover 17 in contact with the periphery of the opening 31*b*.

Figure 8:
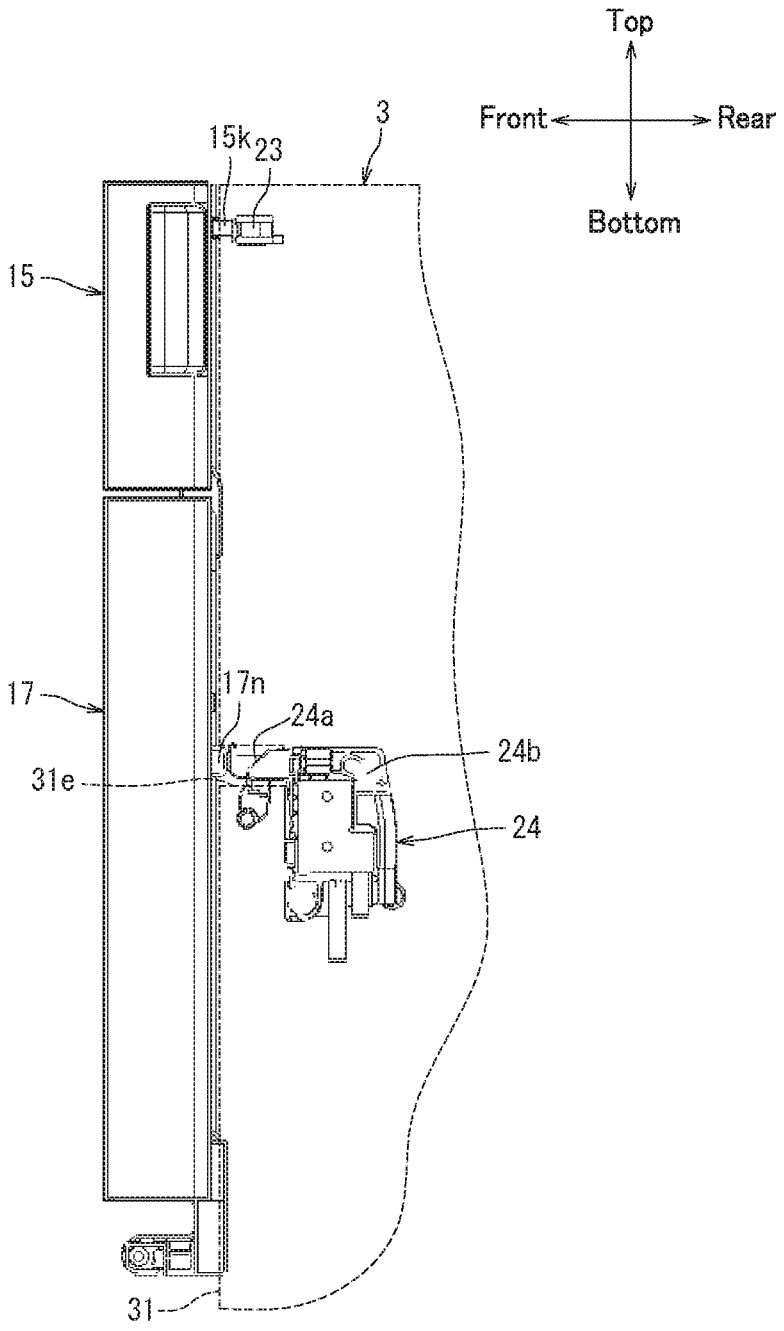
FIG. 8 is a partial cut-away side view of the housing, illustrating arrangement of a cover opening detection switch and an interlock switch.

The following describes the cover opening detection switch 23 and the interlock switch 24 disposed in the housing 3 with reference to FIG. 8. FIG. 8 is a side view of the housing 3 partially shown in phantom, illustrating arrangement of the cover opening detection switch 23 and the interlock switch 24.

The cover opening detection switch 23 detects opening and closing of the front cover 15. The cover opening detection switch 23 is a pushbutton switch of an autonomous recovery type. The cover opening detection switch 23 is pushed by the projection 15*k* of the front cover 15 when the front cover 15 is closed. The cover opening detection switch 23 is turned on when pushed and turned off by autonomous recovery when released.

The interlock switch 24 detects opening and closing of the maintenance cover 17. The interlock switch 24 has the button section 24*a* and a switch body 24*b*. The button section 24*a* is located inside of the hole 31*e* of the housing 3. The button section 24*a* is of an autonomous recovery type. The switch body 24*b* is disposed behind the button section 24*a*. The projection 17*n* of the maintenance cover 17 in the closed state is within the hole 31*e* of the housing 3 and pushes the button section 24*a*. The switch body 24*b* is turned on through the button section 24*a* being pushed and turned off through autonomous recovery of the button section 24*a* being released.

Explanation of Operation

Figure 9:
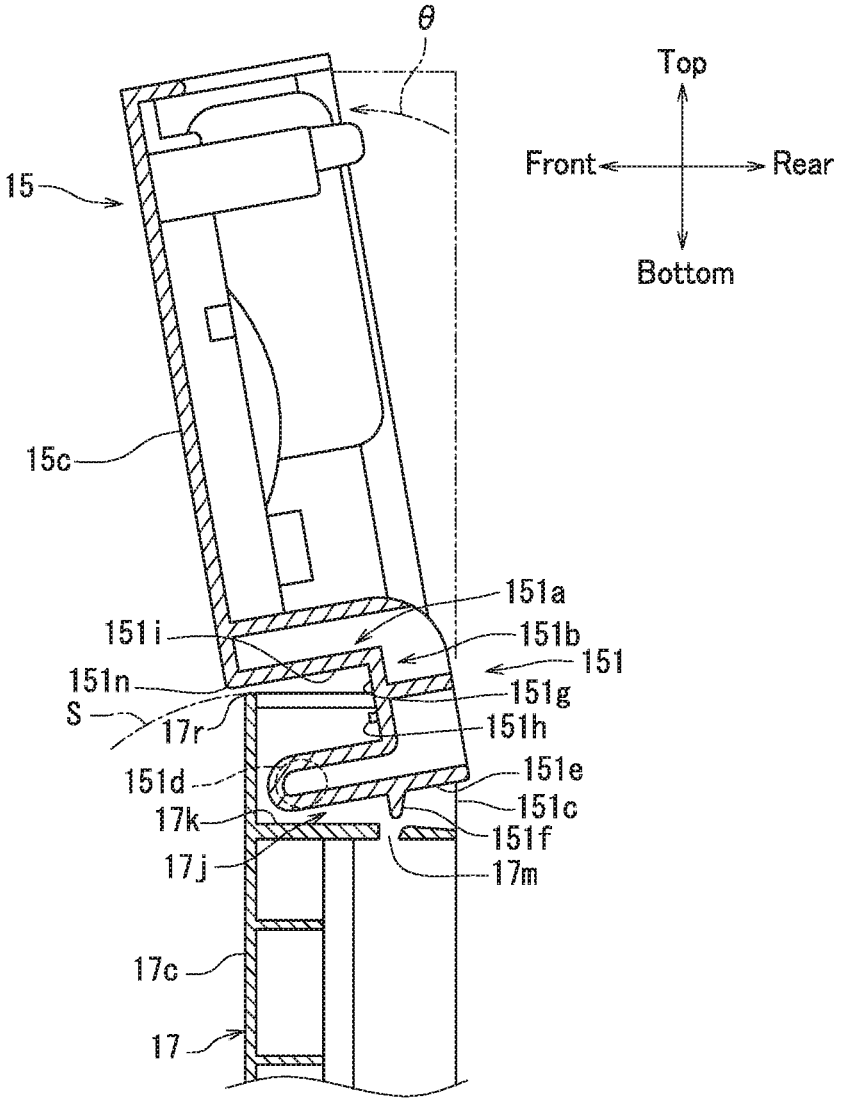
FIG. 9 is a cross-sectional view illustrating the maintenance cover in a closed state and the front cover in a pivoted and opened state.
Figure 10:
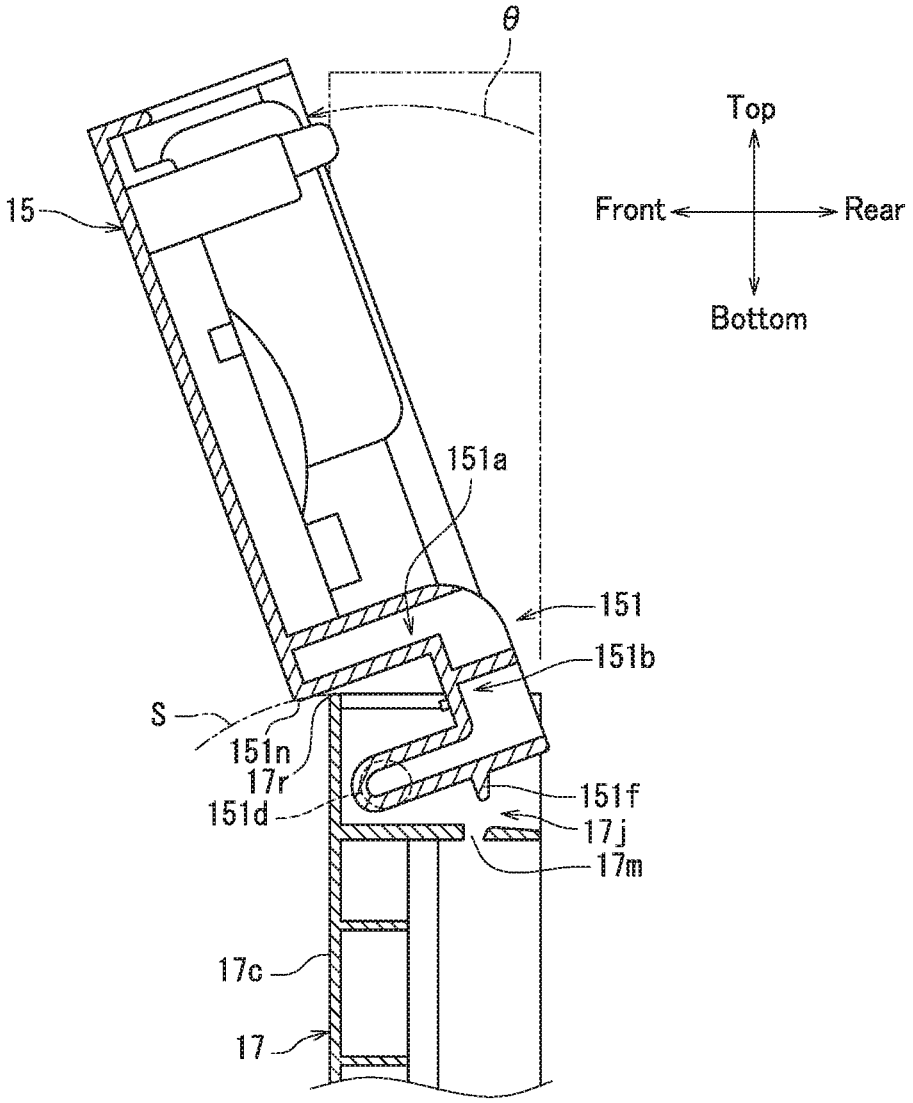
FIG. 10 is a cross-sectional view illustrating the maintenance cover in the closed state and the front cover in a further pivoted and opened state.
Figure 11:
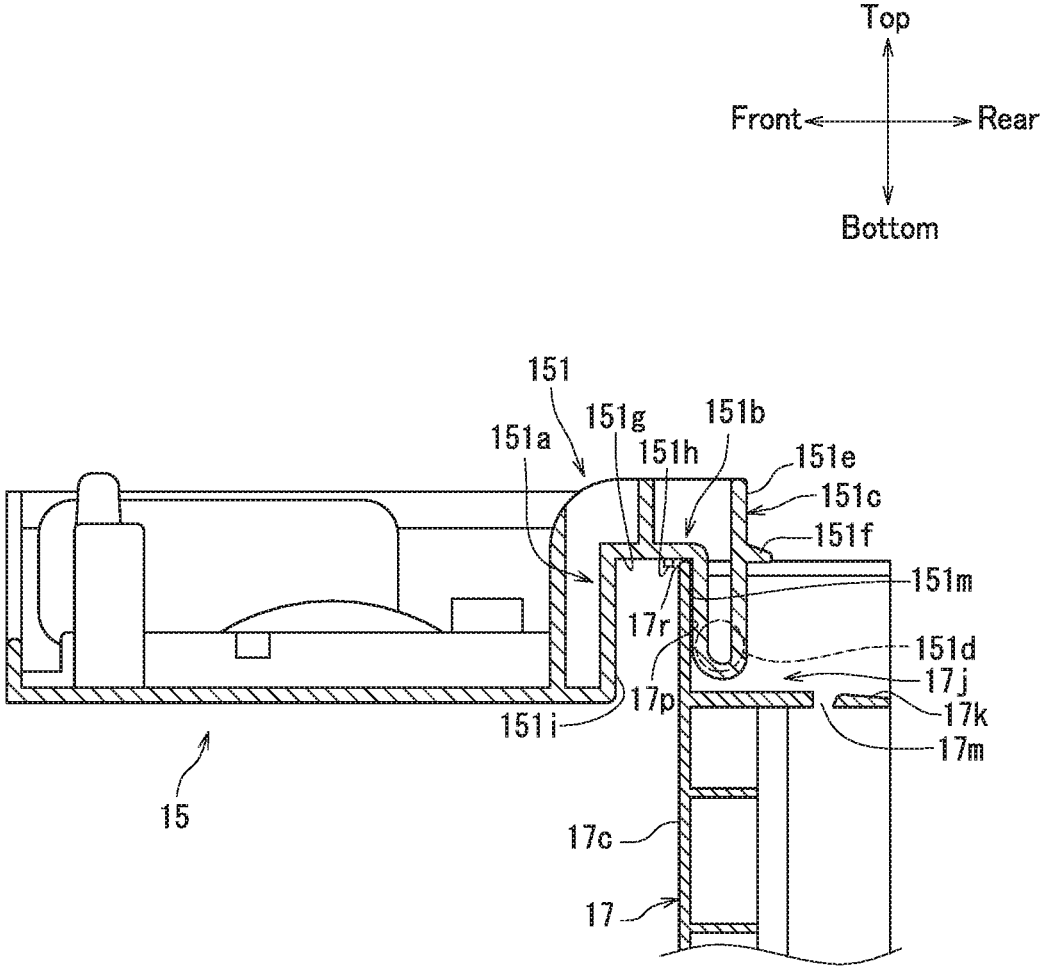
FIG. 11 is a cross-sectional view illustrating the maintenance cover in the closed state and the front cover in a fully opened state.

The following describes operation of a main part (lock mechanism) of the image forming apparatus 1 with reference to FIGS. 3 and 9 to 11. FIG. 9 is a cross-sectional view illustrating the maintenance cover 17 in the closed state and the front cover 15 in a slightly opened state. FIG. 10 is a cross-sectional view illustrating the maintenance cover 17 in the closed state and the front cover 15 in a further opened state. FIG. 11 is a cross-sectional view illustrating the maintenance cover 17 in the closed state and the front cover 15 in a fully opened state. In FIG. 9, the front cover 15 is pivoted by a pivot angle θ (θa≤θ≤θb). In FIG. 10, the front cover 15 is pivoted by a pivot angle θ (θb≤θ). For example, the pivot angle θa is 10°, and the pivot angle θb is 15°.

In FIG. 3, both the front cover 15 and the maintenance cover 17 are closed. The lower surfaces 151*e* of the supporting bases 151*c* of the support sections 151 of the front cover 15 in the closed state are facing toward the bottoms 17*k* of the accommodation recesses 17*j* of the maintenance cover 17 in proximity. The projections 151*f* of the lower surfaces 151*e* are in engagement with the holes 17*m* of the bottoms 17*k*. That is, the first lock mechanism is locked. As a result, the maintenance cover 17 is rendered non-pivotable frontward and locked in the closed state. The first lock mechanism is kept locked and the maintenance cover 17 is locked in the closed state even when the front cover 15 is pivoted by a pivot angle θ (0<θ<θa) to shift from the closed state to an opened state.

The front cover 15 is then further pivoted by a pivot angle θ (θa≤θ<θb) to be in the slightly opened state as illustrated in FIG. 9. When the front cover 15 is in the slightly opened state, the lower surfaces 151*e* of the supporting bases 151*c* of the support sections 151 are separated from the bottoms 17*k* of the accommodation recesses 17*j*, and the projections 151*f* of the lower surfaces 151*e* are out of the holes 17*m* of the bottoms 17*k*. That is, the first lock mechanism is not locked. Front edges 151*n* of the lower surfaces 151*i* of the attachment bases 151*a* of the support sections 151 protrude in front of the front face 17*c* of the maintenance cover 17 for the amount of the frontward pivot of the front cover 15 but do not interfere with the trajectory of the opening movement of the maintenance cover 17. More specifically, the front edges 151*n* do not interfere with a trajectory S followed by the upper edge 17*r* of the front face 17*c* of the maintenance cover 17 when the maintenance cover 17 is slightly opened. That is, the second lock mechanism is not locked, either. Furthermore, the projections 151*h* of the support sections 151 are not in engagement with the front face 17*c* of the maintenance cover 17. That is, the third lock mechanism is not locked, either. Thus, none of the lock mechanisms are locked, allowing the maintenance cover 17 to be pivotable frontward to be open.

The front cover 15 is then further pivoted by a pivot angle θ (θb≤θ) to shift from the slightly opened state to the further opened state as illustrated in FIG. 10. When the front cover 15 is in the further opened state, the front edges 151*n* of the lower surfaces 151*i* of the attachment bases 151*a* of the support sections 151 are positioned in front of the front face 17*c* of the maintenance cover 17 to interfere with the trajectory of the opening movement of the maintenance cover 17. More specifically, the front edges 151*n* interfere with the trajectory S followed by the upper edge 17*r* of the front face 17*c* of the maintenance cover 17 when the maintenance cover 17 is opened. That is, the second lock mechanism is locked. As a result, the maintenance cover 17 is rendered non-pivotable frontward and locked in the closed state.

The front cover 15 is then further pivoted to be in the fully opened state as illustrated in FIG. 11. When the front cover 15 is in the fully opened state, the upper surfaces 151*m* of the supporting bases 151*c* of the support sections 151 are in contact with the front faces 17*p* of the accommodation recesses 17*j*. When the upper surfaces 151*m* are in contact with the front faces 17*p*, the projections 151*h* of the support sections 151 are in engagement with the upper edge 17*r* of the front face 17*c* of the maintenance cover 17. That is, the third lock mechanism is locked. As a result, the maintenance cover 17 is rendered non-pivotable frontward and locked in the closed state.

Each support section 151 is U-shaped with the attachment base 151*a*, the coupling base 151*b*, and the supporting base 151*c*. Consequently, when the front cover 15 is fully opened with the maintenance cover 17 in the closed state, a portion of the maintenance cover 17 around the upper edge 17*r* is accommodated by a space between the attachment bases 151*a* and the supporting bases 151*c*. Thus, the maintenance cover 17 is prevented from restricting an opening movement of the front cover 15. It is therefore possible to widely open the front cover 15.

As described above, the lock mechanism of the image forming apparatus 1 allows the maintenance cover 17 to be opened only when the front cover 15 is open by a pivot angle in a specific range (θa≤θ<θb). This information is given only to a maintainer not to a user. Thus, only a maintainer can open the maintenance cover 17.

The embodiment of the present disclosure has been described above with reference to the drawings (FIGS. 1 to 11). However, the present disclosure is not limited to the above embodiment and may be practiced in various forms without deviating from the essence thereof (for example, as described below in sections (1) to (7)). The drawings schematically illustrate elements of configuration in order to facilitate understanding and properties of elements of configuration illustrated in the drawings, such as thickness, length, and number thereof, may differ from actual properties thereof in order to facilitate preparation of the drawings. Furthermore, properties of elements of configuration described in the above embodiment, such as material properties, shapes, and dimensions, are merely examples and are not intended as specific limitations. Various alterations may be made so long as there is no substantial deviation from the effects of the present disclosure.

(1) Although the lower surfaces 151*e* of the supporting bases 151*c* of the support sections 151 of the front cover 15 have the projections 151*f* and the bottoms 17*k* of the accommodation recesses 17*j* of the maintenance cover 17 have the holes 17*m* in the embodiment described above, the lower surfaces 151*e* may have holes and the bottoms 17*k* may have projections.

(2) Although a part of each support section 151 of the front cover 15 (the lower surface 151*i* of each attachment base 151*a*) functions as the interference section in the embodiment described above, the interference section may be formed separately from each support section 151. In such a configuration, the interference section may have any shape and may be located at any position on the front cover 15, so long as it extends from the lower edge 15*a* of the front face 15*c* toward the open rear face 15*d* of the front cover 15 and interferes with the trajectory of the opening movement of the maintenance cover 17 when the front cover 15 is open by a pivot angle no less than the specific pivot angle θb. Furthermore, in such a configuration, the front edge 151*j* of each lower surface 151*i* does not need to coincide with the lower edge 15*a* of the front face 15*c*. As a result, it is possible that the lower surfaces 151*i* are located at a higher level than the lower edge 15*a* in the rear surface 15*i*.

(3) Although the projections 151*f* are provided on the lower surfaces 151*e* of the support sections 151 in the embodiment described above, the present disclosure is not limited to such a configuration. The projections 151*f* may be provided on any surfaces of the support sections 151 so long as the surfaces are contact surfaces that come in or out of contact with the specific sections of the maintenance cover 17 as the front cover 15 is closed or opened with the maintenance cover 17 in the closed state. In such a configuration, the holes 17*m* of the maintenance cover 17 are provided in the specific sections of the maintenance cover 17.

(4) Although the maintenance cover 17 is a top open cover like the front cover 15 in the embodiment described above, the present disclosure is not limited to such a configuration. The maintenance cover 17 may for example be a right open or left open cover.

(5) Although the present disclosure is applied to the image forming apparatus 1 in the embodiment described above, the present disclosure are applicable to electronic devices other than the image forming apparatus 1 (electronic devices that do not have an image forming section).

(6) The front surfaces 151*g* of the coupling bases 151*b* of the support sections 151 in the embodiment described above may not have the projections 151*h*. In a configuration in which the front surfaces 151*g* do not have the projections 151*h*, the lower surfaces 151*i* of the attachment bases 151*a* of the support sections 151 interfere with the trajectory of the opening movement of the maintenance cover 17 to lock the maintenance cover 17 in the closed state when the front cover 15 is in the fully opened state. When the front cover 15 is in the fully opened state, the projections 151*h* are closer to the front face 17*c* of the maintenance cover 17 than the lower surfaces 151*i*. The maintenance cover 17 can therefore be locked in a closed state that is closer to a completely closed state in the configuration of the embodiment described above in which the front surfaces 151*g* have the projections 151*h* and the projections 151*h* lock the maintenance cover 17 in the closed state than in the configuration without the projections 151*h*. The completely closed state refers to a state in which the maintenance cover 17 is completely closed.

(7) Although each support section 151 is U-shaped with the attachment base 151*a*, the coupling base 151*b*, and the supporting base 151*c* in the embodiment described above, the present disclosure is not limited to such a configuration. The support sections 151 may have any shape so long as the following conditions 1 and 2 are satisfied when the front cover 15 is open with the maintenance cover 17 in the closed state.

Condition 1: The interference sections do not interfere with the trajectory of the opening movement of the maintenance cover 17 when the front cover 15 is open by a pivot angle less than the specific pivot angle θb and interfere with the trajectory of the opening movement of the maintenance cover 17 to lock the maintenance cover 17 in the closed state when the front cover 15 is open by a pivot angle no less than the specific pivot angle θb.

Condition 2: The front cover 15 is openable by a certain pivot angle (for example, a pivot angle of 90°).

What is claimed is:

1. An electronic device comprising:

a main body;

a first cover supported pivotally relative to the main body; and a second cover located adjacent to the first cover and supported pivotally relative to the main body, the first cover having:

a first front face having an edge adjacent to the second cover;

a support section located on a rear surface of the first front face at a side closest to the edge and supported by the main body so as to be pivotable about a pivot axis along the edge; and an interference section extending rearward from the edge and configured to interfere with a trajectory of an opening movement of the second cover when the first cover is open by a pivot angle no less than a specific pivot angle, the second cover having:

a second front face;

a specific section located on a rear surface of the second front face at a side closest to the first cover and faced toward the first cover; and one of a protrusion and a recess that is located on or in the specific section, the support section of the first cover having:

a contact surface that comes in or out of contact with the specific section of the second cover as the first cover is closed or opened with the second cover in a closed state; and the other of the protrusion and the recess that is located on or in the contact surface, wherein the protrusion fits in the recess when the first cover is closed with the second cover in the closed state, and the protrusion comes out of the recess when the first cover is opened with the second cover in the closed state, and the interference section locks the second cover in the closed state when the first cover is open by the pivot angle no less than the specific pivot angle.

2. The electronic device according to claim 1, wherein the support section of the first cover has a first base, a second base, and a third base, the first base extends rearward from the rear surface of the first front face, the second base extends, from a distal end of the first base, closer to the second cover than the edge of the first face, the third base extends from a distal end of the second base toward the first face, and the support section of the first cover is supported by the main body at a distal end of the third base so as to be pivotable about the pivot axis.

3. The electronic device according to claim 2, wherein a surface on a side of the first base that faces toward the third base is the interference section.

4. The electronic device according to claim 2, wherein a surface on a side of the third base that faces toward the specific section is the contact surface and has the other of the protrusion and the recess.

5. The electronic device according to claim 2, wherein a surface on a side of the second base that faces toward the first front face has a projection, and the projection engages with the second front face of the second cover when the first cover is fully opened with the second cover in the closed state.

6. The electronic device according to claim 2, wherein the support section of the first cover is located behind the second cover when the first cover is closed with the second cover in the closed state.

7. The electronic device according to claim 2, wherein the third base has a first convex corner and a second convex corner, the first convex corner is formed by a boundary between the distal end and an upper surface of the third base, the second convex corner is formed by a boundary between the distal end and a lower surface of the third base, and the first convex corner and the second convex corner are beveled in an arc shape.

8. The electronic device according to claim 2, wherein a top face of the second cover has an accommodation recess, the accommodation recess accommodates the support section of the first cover, the accommodation recess is elongated in a front-rear direction of the second cover, a front face of the accommodation recess is closed by the rear surface of the second front face, and a bottom of the accommodation recess is the specific section.

9. The electronic device according to claim 8, wherein the distal end of the third base is located near a concave corner of the accommodation recess, and the concave corner is formed by a boundary between the front face and the bottom of the accommodation recess.

10. The electronic device according to claim 1, wherein a pivot axis of the second cover is parallel to the pivot axis of the first cover and is located at a side of the second front face that is farthest from the first cover.

11. The electronic device according to claim 1, wherein the main body includes a cover opening detection switch configured to detect opening and closing of the first cover, the first cover has a projection configured to push the cover opening detection switch, and the projection is located on the rear surface of the first cover at a position above the support section.

12. An image forming apparatus comprising:

the electronic device according to claim 1; and an image forming section configured to form an image on paper.

13. The electronic device according to claim 1, wherein the second cover is pivotable from the closed state to be in an opened state only when the first cover is pivoted to be opened from a closed state by a pivot angle no less than a first pivot angle and less than a second pivot angle, and the second pivot angle is larger than the first pivot angle.

14. The electronic device according to claim 1, wherein the protrusion fits in the recess to lock the second cover in the closed state when the first cover is open by a pivot angle less than a first pivot angle.

* * * * *